US011232750B2

(12) United States Patent
Wang et al.

(10) Patent No.: US 11,232,750 B2
(45) Date of Patent: Jan. 25, 2022

(54) DISPLAY SUBSTRATE, DISPLAY PANEL, AND MANUFACTURING METHOD AND DRIVING METHOD OF DISPLAY SUBSTRATE

(71) Applicant: BOE TECHNOLOGY GROUP CO., LTD., Beijing (CN)

(72) Inventors: Lizhong Wang, Beijing (CN); Rui Huang, Beijing (CN); Yupeng Gao, Beijing (CN); Jiangnan Lu, Beijing (CN); Shuilang Dong, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 45 days.

(21) Appl. No.: 16/633,377

(22) PCT Filed: Jan. 29, 2019

(86) PCT No.: PCT/CN2019/073706
§ 371 (c)(1),
(2) Date: Jan. 23, 2020

(87) PCT Pub. No.: WO2020/154894
PCT Pub. Date: Aug. 6, 2020

(65) Prior Publication Data
US 2021/0225286 A1 Jul. 22, 2021

(51) Int. Cl.
*G09G 3/3258* (2016.01)
*G09G 3/3291* (2016.01)

(52) U.S. Cl.
CPC ..... *G09G 3/3258* (2013.01); *G09G 3/3291* (2013.01); *G09G 2360/148* (2013.01)

(58) Field of Classification Search
CPC .... G09G 3/3258; G09G 3/3291; G06F 3/042; H01L 27/14612; H01L 27/14625;
(Continued)

(56) References Cited

U.S. PATENT DOCUMENTS 8,928,644 B2 * 1/2015 Kurokawa ..... G06F 3/04164 345/211
9,007,353 B2 4/2015 Kuo et al.
(Continued)

FOREIGN PATENT DOCUMENTS

CN 101976679 A 2/2011
CN 104882457 A 9/2015
(Continued)

OTHER PUBLICATIONS

Chinese Office Action in Chinese Application No. 201980000104.3 dated May 28, 2021, with English translation.

*Primary Examiner* — Sardis F Azongha
(74) *Attorney, Agent, or Firm* — Collard & Roe, P.C.

(57) ABSTRACT

A display substrate, a display panel, and a manufacturing method and a driving method of a display substrate are provided. The display substrate includes a base substrate, a pixel circuit, and a photosensitive unit. The pixel circuit and the photosensitive unit are on the base substrate, the pixel circuit includes a first transistor, and an orthographic projection of the photosensitive unit on the base substrate at least partially overlaps with an orthographic projection of the first transistor on the base substrate.

18 Claims, 7 Drawing Sheets

(58) Field of Classification Search
CPC ..... H01L 27/288; H01L 27/3234; H01L 27/3244; H01L 27/3262
See application file for complete search history.

(56) References Cited

U.S. PATENT DOCUMENTS

| | | | | |
|---|---|---|---|---|
| 10,747,978 | B2 | 8/2020 | Ding et al. | |
| 2010/0007632 | A1 | 1/2010 | Yamazaki | |
| 2013/0162602 | A1* | 6/2013 | Nakagawa | H01L 27/14601 345/175 |
| 2015/0325171 | A1* | 11/2015 | Zhou | G09G 3/32 345/80 |
| 2016/0233268 | A1 | 8/2016 | Jiroku | |
| 2019/0067385 | A1 | 2/2019 | Xu et al. | |
| 2020/0029048 | A1 | 1/2020 | Ding et al. | |

FOREIGN PATENT DOCUMENTS

| | | | |
|---|---|---|---|
| CN | 107425038 | A | 12/2017 |
| CN | 107579101 | A | 1/2018 |
| CN | 108922940 | A | 11/2018 |
| JP | 2009-282361 | A | 12/2009 |

* cited by examiner

DISPLAY SUBSTRATE, DISPLAY PANEL, AND MANUFACTURING METHOD AND DRIVING METHOD OF DISPLAY SUBSTRATE

CROSS REFERENCE TO RELATED APPLICATIONS

This application is the National Stage of PCT/CN2019/073706 filed on Jan. 29, 2019, the disclosure of which is incorporated by reference.

TECHNICAL FIELD

Embodiments of the present disclosure relate to a display substrate, a display panel, and a manufacturing method and a driving method of a display substrate.

BACKGROUND

Compared with traditional liquid crystal panels, organic light-emitting diode (OLED) display panels have advantages such as the faster response speed, higher contrast ratio, wider viewing angle, and lower power consumption, and have been increasingly used for high-performance display. In recent years, with OLED full-screen display panels gradually entering the market, the requirements of the corresponding full-screen fingerprint identification and touch technology may also be extremely urgent. The display sensing technology can implement the integration of the optical fingerprint and the optical touch function of the OLED display panel, thereby greatly increasing the added value of the OLED display module.

SUMMARY

At least an embodiment of the present disclosure provides a display substrate, and the display substrate includes a base substrate, a pixel circuit, and a photosensitive unit. The pixel circuit and the photosensitive unit are on the base substrate, the pixel circuit includes a first transistor, and an orthographic projection of the photosensitive unit on the base substrate at least partially overlaps with an orthographic projection of the first transistor on the base substrate.

For example, in the display substrate provided by at least an embodiment of the present disclosure, the orthographic projection of the photosensitive unit on the base substrate is within the orthographic projection of the first transistor on the base substrate.

For example, in the display substrate provided by at least an embodiment of the present disclosure, the photosensitive unit is a photodiode and is on a side, away from the base substrate, of the first transistor, the photodiode includes a first electrode and a second electrode, the first electrode of the photodiode is configured to receive a bias voltage to bias the photodiode, and the second electrode of the photodiode is configured to be electrically connected to the first transistor.

For example, in the display substrate provided by at least an embodiment of the present disclosure, the first transistor includes a control electrode, and the control electrode of the first transistor is configured to be electrically connected to the second electrode of the photodiode.

For example, in the display substrate provided by at least an embodiment of the present disclosure, the second electrode of the photodiode is further configured to be the control electrode of the first transistor, the photodiode further includes a photosensitive layer, and the photosensitive layer is between the second electrode of the photodiode and the first electrode of the photodiode relative to the base substrate.

For example, the display substrate provided by at least an embodiment of the present disclosure further includes a detection circuit, and the detection circuit is configured to be electrically connected to the second electrode of the photodiode to detect an electrical signal of the second electrode of the photodiode.

For example, the display substrate provided by at least an embodiment of the present disclosure further includes a signal line, and the first electrode of the photodiode is electrically connected to the signal line.

For example, the display substrate provided by at least an embodiment of the present disclosure further includes a signal line and a bias voltage line, and the signal line and the bias voltage line are electrically connected to the first electrode of the photodiode, respectively.

For example, in the display substrate provided by at least an embodiment of the present disclosure, the pixel circuit further includes a second transistor, a first electrode of the second transistor is electrically connected to the signal line, a control electrode of the second transistor is electrically connected to a gate line, a second electrode of the second transistor is electrically connected to the first electrode of the photodiode, the second electrode of the photodiode is electrically connected to the control electrode of the first transistor, a first electrode of the first transistor is electrically connected to a power voltage terminal, and a second electrode of the first transistor is electrically connected to a light-emitting component.

For example, the display substrate provided by at least an embodiment of the present disclosure includes a plurality of pixel circuits and a plurality of photosensitive units, the plurality of pixel circuits and the plurality of photosensitive units are on the base substrate in an overlapping manner, and the plurality of pixel circuits and the plurality of photosensitive units are in one-to-one correspondence.

At least an embodiment of the present disclosure further provides a display panel, and the display panel includes the display substrate provided by any one of the embodiments of the present disclosure.

At least an embodiment of the present disclosure further provides a method for manufacturing the display substrate provided by any one of the embodiments of the present disclosure, and the method includes: providing the base substrate, forming the pixel circuit on the base substrate, and forming the photosensitive unit on the base substrate on which the pixel circuit is formed, so as to allow the orthographic projection of the photosensitive unit on the base substrate to at least partially overlap with the orthographic projection of the first transistor of the pixel circuit on the base substrate.

At least an embodiment of the present disclosure further provides a method for driving the display substrate provided by any one of the embodiments of the present disclosure, and the method includes: in a first phase, applying a first voltage to the photosensitive unit to bias the photosensitive unit and allowing the photosensitive unit to convert an optical signal into an electrical signal; and in a second phase, applying a second voltage to the photosensitive unit to allow the photosensitive unit to be turned on, and allowing the pixel circuit to drive a light-emitting component to emit light.

For example, in the method for driving the display substrate provided by at least an embodiment of the present disclosure, the photosensitive unit is electrically connected to a signal line, the first voltage is applied to the photosensitive unit through the signal line to bias the photosensitive unit, and the second voltage is applied to the photosensitive unit through the signal line to allow the photosensitive unit to be turned on.

For example, in the method for driving the display substrate provided by at least an embodiment of the present disclosure, in a case where the pixel circuit further includes a second transistor and the signal line is a data line, the method further includes: in the first phase, controlling the second transistor to be turned on and applying the first voltage to the photosensitive unit through the signal line to bias the photosensitive unit; and in the second phase, controlling the second transistor to be turned on and applying the second voltage to the photosensitive unit through the signal line to allow the photosensitive unit to be turned on, where the second voltage is a data voltage.

BRIEF DESCRIPTION OF THE DRAWINGS

In order to clearly illustrate the technical solution of the embodiments of the present disclosure, the drawings of the embodiments will be briefly described in the following. It is obvious that the described drawings in the following are only related to some embodiments of the present disclosure and thus are not limitative of the present disclosure.

DETAILED DESCRIPTION

Figure 1:
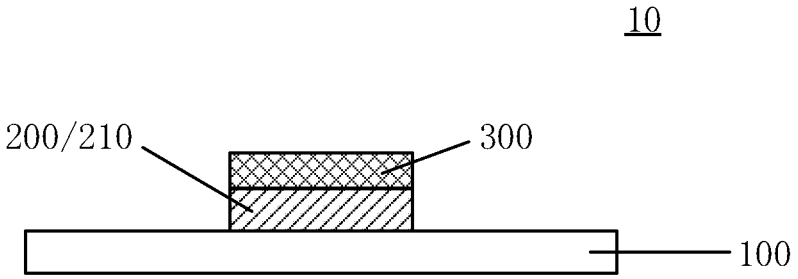
FIG. 1 is a structural schematic diagram of a display substrate provided by some embodiments of the present disclosure.

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," "the", etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects.

Currently, the fingerprint identification technology based on the glass substrate and applied to the organic light-emitting diode (OLED) display module is still in the early phase. The OLED display panel and related products can only implement fingerprint identification in the partial screen, or the fingerprint identification circuit is embedded at the expense of the pixel density of the display panel, which may affect the display effect of the image.

At least an embodiment of the present disclosure provides a display substrate, and the display substrate includes a base substrate, a pixel circuit, and a photosensitive unit. The pixel circuit and the photosensitive unit are disposed on the base substrate. The pixel circuit includes a first transistor. An orthographic projection of the photosensitive unit on the base substrate at least partially overlaps with an orthographic projection of the first transistor on the base substrate, or the orthographic projection of the photosensitive unit on the base substrate is within the orthographic projection of the first transistor on the base substrate, that is, the first transistor overlaps with the photosensitive unit in a direction perpendicular to the base substrate. The display substrate uses a vertical structure to allow the transistor of the pixel circuit to overlap with the photosensitive unit applied to fingerprint identification, and solves the problem that the photosensitive unit occupies the effective pixel area, thereby increasing the pixel density of the display substrate, improving the display effect of the image, and allowing the display substrate to implement the technical effect of full-screen fingerprint identification. In some embodiments, each photosensitive unit can be independently controlled, which further improves the sensitivity of fingerprint identification. In addition, the overlapping manner can also simplify the process of manufacturing the display substrate, thereby reducing the complexity of the process, increasing the success rate of preparation, and providing an extremely high application value.

At least an embodiment of the present disclosure further provides a manufacturing method and a driving method of the above display substrate, and a display panel including the above display substrate.

The method for manufacturing the display substrate includes: providing the base substrate; forming the pixel circuit on the base substrate; and forming the photosensitive unit on the base substrate on which the pixel circuit is formed, so as to allow the orthographic projection of the photosensitive unit on the base substrate to at least partially overlap with the orthographic projection of the first transistor of the pixel circuit on the base substrate.

The method for driving the display substrate includes: in a first phase, applying a first voltage to the photosensitive unit to bias the photosensitive unit and allowing the photosensitive unit to convert an optical signal into an electrical signal; and in a second phase, applying a second voltage to the photosensitive unit to allow the photosensitive unit to be turned on, and allowing the pixel circuit to drive a light-emitting component to emit light.

Hereinafter, some embodiments of the present disclosure will be described in detail with reference to the accompanying drawings. It should be noted that the same reference numerals in different drawings will be used to indicate the same components described.

FIG. 1 is a structural schematic diagram of a display substrate 10 provided by some embodiments of the present disclosure. The display substrate 10 includes a base substrate 100, a pixel circuit 200, and a photosensitive unit 300. As illustrated in FIG. 1, the pixel circuit 200 and the photosensitive unit 300 are disposed on the base substrate 100, the pixel circuit 200 includes a first transistor 210, an orthographic projection of the photosensitive unit 300 on the base substrate 100 at least partially overlaps with an orthographic projection of the first transistor 210 on the base substrate 100, and the photosensitive unit 300 is disposed on a side, away from the base substrate 100, of the first transistor 210.

In the display substrate 10, the first transistor 210 of the pixel circuit 200 and the photosensitive unit 300 applied to fingerprint identification are disposed by using the vertical structure, so that the problem that the photosensitive unit 300 occupies the effective pixel area is solved, thereby increasing the pixel density of the display substrate 10, improving the display effect of the image, and optimizing the integration manner of the optical fingerprint identification function with the display device.

For example, as illustrated in FIG. 1, in one example, the orthographic projection of the photosensitive unit 300 on the base substrate 100 may further be within the orthographic projection of the first transistor 210 on the base substrate 100, that is, the entire orthographic projection of the photosensitive unit 300 including respective portions on the base substrate 100 is within the entire orthographic projection of the first transistor 210 including respective portions on the base substrate 100. For example, the orthographic projection of the photosensitive unit 300 on the base substrate 100 completely overlaps with the orthographic projection of the first transistor 210 on the base substrate 100.

For example, the display substrate 10 may include a pixel array, the pixel array includes a plurality of pixel units, and each of the pixel units includes the pixel circuit 200. The display substrate 10 includes a plurality of pixel circuits 200 and a plurality of photosensitive units 300. For example, each pixel circuit 200 corresponds to one photosensitive unit 300, that is, the plurality of pixel circuits 200 and the plurality of photosensitive units 300 are in one-to-one correspondence, and each photosensitive unit 300 overlaps with the first transistor 210 of the corresponding pixel circuit 200 in the direction perpendicular to the base substrate 100. Each pixel region of the display substrate 10 is provided with one photosensitive unit 300, so that fingerprint identification can be accurate to each pixel of the display substrate 10, and the display substrate 10 can implement the technical effect of full-screen fingerprint identification, thereby greatly improving the sensitivity of fingerprint identification.

According to different practical application requirements, corresponding photosensitive units 300 may also be provided only for a part of the pixel circuits 200 of the display substrate 10. For example, the corresponding photosensitive units 300 may be provided only for the pixel circuits 200 in a certain area of the display substrate 10, so that the fingerprint identification operation is limited to a specified area of the display substrate 10, thereby saving the manufacturing cost of the display substrate 10 and reducing the driving power consumption of performing the fingerprint identification. For example, the density of arrangement of the photosensitive units 300 in the display substrate 10 can further be reduced, and one photosensitive unit 300 is correspondingly arranged at intervals of one or more pixel circuits 200 in the display substrate 10, thereby reducing the manufacturing cost of the display substrate 10 and simplifying the manufacturing process in the case of full-screen fingerprint identification.

In the embodiments of the present disclosure, the photosensitive unit 300 may be a photodiode, a photosensitive resistor, or photosensitive devices of other types. In the following, the photodiode is taken as an example for specific description of the integration of the photosensitive unit 300 with the display substrate 10.

Figure 2:
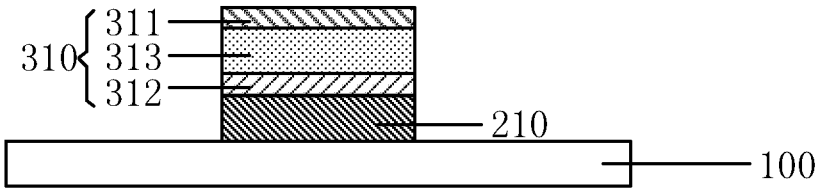
FIG. 2 is a structural schematic diagram of a photodiode provided by some embodiments of the present disclosure.

FIG. 2 is a structural schematic diagram of a photodiode 310 provided by some embodiments of the present disclosure. As illustrated in FIG. 2, the photodiode 310 includes a first electrode 311, a second electrode 312, and a photosensitive layer 313. The photosensitive layer 313 is between the second electrode 312 and the first electrodes 311 relative to the base substrate 100, that is, the photosensitive layer 313 is on the side, away from the base substrate 100, of the second electrode 312, and the first electrode 311 is on the side, away from the second electrode 312, of the photosensitive layer 313. The second electrode 312 is electrically connected to the first transistor 210. During fingerprint identification, because of the concave-convex of the fingerprint, the concave portion and the convex portion of the fingerprint have different reflection intensities of light, the photosensitive layer 313 of the photodiode 310 can convert different light intensities reflected by the concave portion and the convex portion of the fingerprint into photocurrents of different magnitudes, and the display substrate 10 determines the pattern of the fingerprint according to the generated photocurrents of different magnitudes, thereby implementing the fingerprint identification function.

For example, the first transistor 210 may be a top-gate transistor, a bottom-gate transistor, or the like. The second electrode 312 of the photodiode 310 can be electrically connected to the control electrode (e.g., the gate electrode) of the first transistor 210, and the second electrode 312 of the photodiode 310 can be formed integrally with the control electrode of the first transistor 210 in the process of manufacturing the display substrate 10, that is, the control electrode of the first transistor 210 can also be used as the second electrode 312 of the photodiode 310, thereby simplifying the process of manufacturing the display substrate 10, reducing the complexity of the process, increasing the success rate of preparation, and providing an extremely high application value.

The specific structure of the display substrate 10 is described below by taking a case that the first transistor 210 is a top-gate thin film transistor and the photodiode 310 is a P-I-N structure diode.

Figure 3:
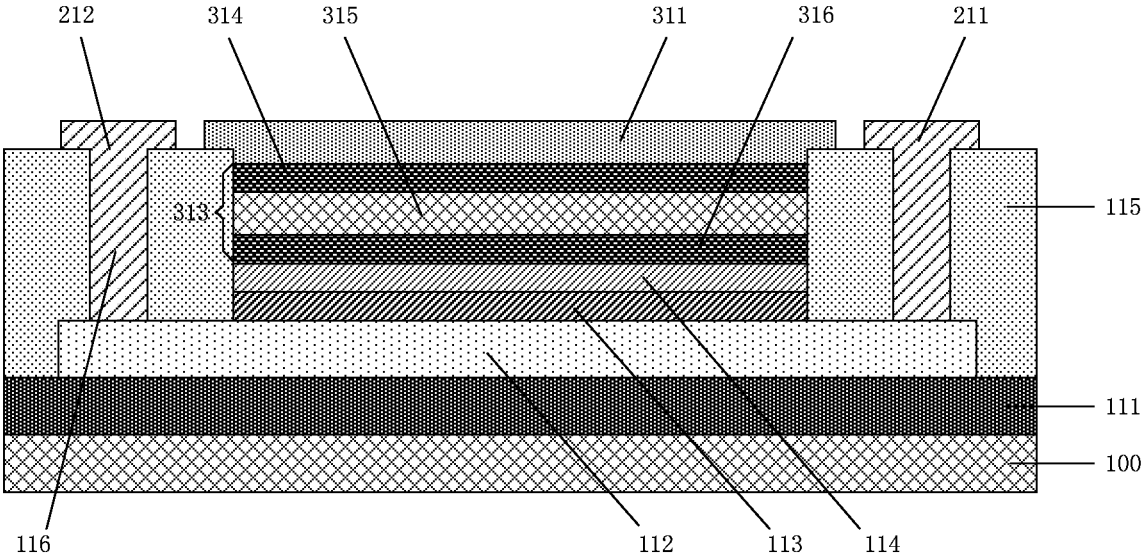
FIG. 3 is a schematic diagram of a partial cross-sectional structure of an example of a display substrate provided by some embodiments of the present disclosure.

FIG. 3 is a schematic diagram of a partial cross-sectional structure of an example of the display substrate 10 provided by some embodiments of the present disclosure, and for example, FIG. 3 is a schematic diagram of a partial cross-sectional structure of one pixel unit. The first transistor 210 and the photodiode 310 are disposed on the base substrate 100 of the display panel 10. As illustrated in FIG. 3, a gate metal layer 114 functions as both the control electrode of the first transistor 210 and the second electrode 312 of the photodiode 310.

It should be noted that, according to different practical requirements, the control electrode of the first transistor 210 and the second electrode 312 of the photodiode 310 may use independent structures, respectively, and the embodiments of the present disclosure are not limited in this aspect. For example, subsequent to forming the control electrode of the first transistor 210, an insulating layer is formed on the control electrode of the first transistor 210, and then the second electrode 312 of the photodiode 310 is formed on the insulating layer.

For example, as illustrated in FIG. 3, the photosensitive layer 313 of the photodiode 310 may include an amorphous silicon p+-a-Si layer 314 doped with p+ ion, an intrinsic amorphous silicon I-a-Si layer 315, and an amorphous silicon n+-a-Si layer 316 doped with n+ ion, which are sequentially stacked. The photosensitive layer 313 may be directly formed by a plasma enhanced chemical vapor deposition (PECVD) method, or may be gradually formed through a doping process. The thickness of the amorphous silicon p+-a-Si layer 314 doped with the p+ ion may be 10 nm to 20 nm, the thickness of the intrinsic amorphous silicon I-a-Si layer 315 may be 500 nm to 1000 nm, and the thickness of the amorphous silicon n+-a-Si layer 316 doped with the n+ ion may be 10 nm to 50 nm.

For example, as illustrated in FIG. 3, a first insulating layer 111 is further provided on the base substrate 100, an active layer 112 of the first transistor 210 is provided on the first insulating layer 111, and a gate insulating layer 113, the gate metal layer 114, the n+-a-Si layer 316 of the photosensitive layer 313, the I-a-Si layer 315 of the photosensitive layer 313, and the p+-a-Si layer 314 of the photosensitive layer 313 are sequentially provided on the active layer 112. A second insulating layer 115 is further provided on the active layer 112, and the first electrode 211 and the second electrode 212 (for example, the source electrode and the drain electrode) of the first transistor 210 are respectively electrically connected to the active layer 112 through a via hole structure 116 in the second insulating layer 115. The first electrode 311 of the photodiode 310 is formed on the second insulating layer 115 and the photosensitive layer 313. It should be noted that during the process of forming the first electrode 211 and the second electrode 212 of the first transistor 210 through the patterning process, if the material characteristics of the active layer 112 are easily affected in the etching process, an etching barrier layer can further be provided on the active layer 112, and the embodiments of the present disclosure are not limited in this aspect.

For example, the base substrate 100 may be a transparent glass substrate, a transparent plastic substrate, etc., and may be, for example, a rigid substrate or a flexible substrate.

For example, the first insulating layer 111 is generally formed by using an organic insulating material (such as acrylic resin) or an inorganic insulating material (such as silicon nitride (SiNx), or silicon oxide (SiOx)). The first insulating layer 111 may have a single-layer structure composed of silicon nitride or silicon oxide, or may have a double-layer structure composed of silicon nitride and silicon oxide. For example, the first insulating layer 111 may include a laminated layer of one silicon nitride layer with a thickness of 50 nm to 150 nm and one silicon dioxide ($SiO_2$) layer with a thickness of 100 nm to 400 nm.

For example, the active layer 112 is formed of a semiconductor material, and for example, the semiconductor material may be amorphous silicon, microcrystalline silicon, polysilicon, an oxide semiconductor, or the like. For example, the oxide semiconductor material may be indium gallium zinc oxide (IGZO) or zinc oxide (ZnO) in the uncrystalline state, quasi-crystalline state, or crystalline state. The areas where the active layer 112 is in contact with the first electrode 211 and the second electrode 212 of the first transistor 210 can be conductive through the processes of plasma processing and high temperature processing, so that the transmission of the electrical signal can be better implemented.

For example, the material used as the gate insulating layer 113 includes silicon nitride (SiNx), silicon oxide (SiOx), aluminum oxide ($Al_2O_3$), aluminum nitride (AlN), or other suitable materials. For example, the gate insulating layer 113 may have a single-layer structure composed of $SiO_2$, or may have a laminated structure composed of SiN and $SiO_2$, and the thickness of the gate insulating layer 113 is 80 nm to 150 nm.

For example, the materials of the gate metal layer 114, the first electrode 211 of the first transistor 210, and the second electrode 212 of the first transistor 210 may include the copper-based metal, such as copper (Cu), copper-molybdenum alloy (Cu/Mo), copper-titanium alloy (Cu/Ti), copper-molybdenum-titanium alloy (Cu/Mo/Ti), copper-molybdenum-tungsten alloy (Cu/Mo/W), copper-molybdenum-niobium alloy (Cu/Mo/Nb), etc.; alternatively, may include the chromium-based metal, such as, chromium-molybdenum alloy (Cr/Mo), chromium-titanium alloy (Cr/Ti), chromium-molybdenum-titanium alloy (Cr/Mo/Ti), or other suitable materials. For example, the thickness of the gate metal layer 114 may be 200 nm to 400 nm.

For example, the second insulating layer 115 is generally formed by using an organic insulating material (such as acrylic resin) or an inorganic insulating material (such as silicon nitride (SiNx) or silicon oxide (SiOx)). For example, the second insulating layer 115 may have a single-layer structure composed of silicon nitride or silicon oxide, or may have a double-layer structure composed of silicon nitride and silicon oxide.

It should be noted that, in the embodiments of the present disclosure, "the first transistor 210 overlaps with the photosensitive unit 300 in the direction perpendicular to the base substrate 100" may indicate that at least part of the layer structures (for example, the first electrode 311, the photosensitive layer 313, and the second electrode of the photodiode 312) of the photosensitive unit 300 overlaps with a part of the layer structures (for example, the active layer 112, the gate insulating layer 113, the gate electrode, etc.) of the first transistor 210, and is located on a side, away from the base substrate 100, of the part of the layer structures of the first transistor 210. For example, as illustrated in FIG. 3, in the direction perpendicular to the base substrate 100, the first electrode 311, the photosensitive layer 313, and the second electrode 312 of the photodiode 310 are on a side, away from the base substrate 100, of the gate insulating layer 113 of the first transistor 210. However, the embodiments of the present disclosure are not limited to the above-described cases, and "the first transistor 210 overlaps with the photosensitive unit 300 in the direction perpendicular to the base substrate 100" may further indicate that all layer structures of the photosensitive unit 300 overlap with all layer structures of the first transistor 210 in the direction perpendicular to the base substrate 100, and are located on a side, away from the base substrate 100, of the all layer structures of the first transistor 210. For example, in some embodiments, subsequent to forming the first electrode 211 and the second electrode 212 of the first transistor 210, a third insulating layer is formed on a side, away from the base substrate 100, of the first electrode 211 and the second electrode 212 of the first transistor 210 and the second insulating layer 115, and then the second electrode 312, the photosensitive layer 313, and the first electrode 311 of the photodiode 310 are sequentially formed on the third insulating layer.

Figure 4:
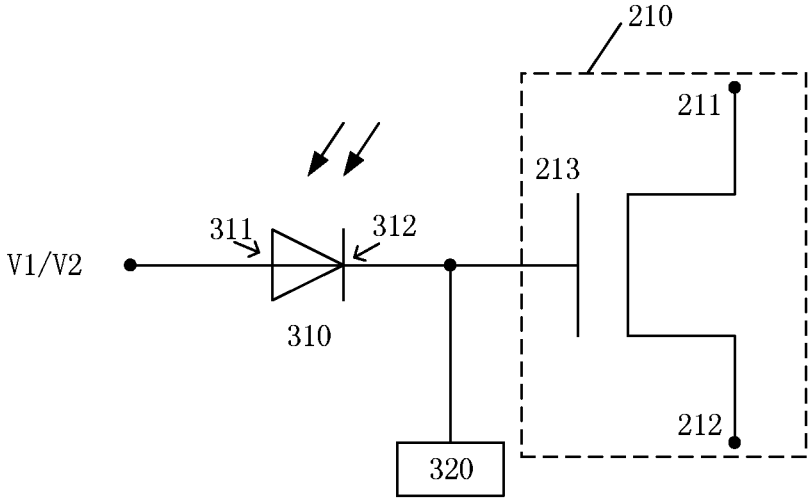
FIG. 4 is a circuit schematic diagram of a working principle of a photodiode provided by some embodiments of the present disclosure.

FIG. 4 is a circuit schematic diagram of a working principle of the photodiode 310 provided by some embodiments of the present disclosure. As illustrated in FIG. 4, the first transistor 210 includes the first electrode 211, the second electrode 212, and the control electrode 213 (the gate electrode), and the second electrode 312 of the photodiode 310 is electrically connected to the control electrode 213 of the first transistor 210.

When the display substrate 10 performs the fingerprint identification operation, the first electrode 311 of the photodiode 310 is configured to receive a bias voltage V1 (e.g., a negative voltage) to bias the photodiode 310, and the photosensitive layer of the biased photodiode 310 converts the optical signal reflected by the fingerprint into the electrical signal (such as a current signal or a voltage signal), thereby implementing the fingerprint identification function. For example, the photodiode 310 can convert the received light reflected by the fingerprint into the photocurrent, the photocurrent flows through the second electrode 312 of the photodiode 310, and therefore, the intensity of light reflected by the fingerprint can be determined by detecting the voltage or the current of the second electrode 312 the photodiode 310, thereby obtaining the specific pattern of the fingerprint and implementing the fingerprint identification function. In addition, in at least one example, the photodiode 310 can implement controlling each pixel independently, which may further improve the sensitivity of fingerprint identification.

For example, "biasing the photodiode 310" means that the photodiode 310 is in a reverse bias state, and in this case, the photodiode 310 is turned off, that is, there is only a weak reverse current between the first electrode 311 of the photodiode 310 and the second electrode 312 of the photodiode 310. In a case where no light is provided, the reverse current is extremely weak, and in this case, the reverse current is referred to as the dark current. In a case where light is provided, the photosensitive layer of the photodiode 310 can convert the optical signal into the electrical signal, so that the reverse current rapidly increases to, for example, dozens of milliamperes, and in this case, the reverse current is referred to as the photocurrent.

It should be noted that in a case where the bias voltage V1 is applied to the first electrode 311 of the photodiode 310, the voltage of the first electrode 311 needs to be lower than the voltage of the second electrode 312, so as to allow the photodiode 310 to be in a reverse bias state. For example, according to different connecting manners of the photodiode 310 in the pixel circuit, a reset circuit electrically connected to the second electrode 312 may be provided, so that during performing the fingerprint identification operation, the voltage of the second electrode 312 can be reset by the reset circuit to allow the voltage of the second electrode 312 to be higher than the bias voltage V1, thereby allowing the photodiode 310 to be biased under control of the bias voltage V1.

It should be noted that, although only one photodiode 310 is illustrated in FIG. 4, those skilled in the art should understand that one valley-ridge detection of the fingerprint needs a plurality of corresponding photodiodes 310, so as to facilitate ensuring the clarity of the identified fingerprint and improving the accuracy of fingerprint identification.

Furthermore, the light used for fingerprint identification in the embodiments may be provided from a light source module disposed inside a display device including the display substrate 10, or may be provided from a light-emitting component of a pixel unit for display (in this case, it is not necessary to additionally provide the light source module). For example, the light source module may be a light-emitting component disposed on the base substrate 100. Alternatively, the light used for fingerprint identification may further be provided from a light source module disposed outside the display device including the display substrate 10, and for example, the light source module may be a backlight source disposed on a side, away from the photodiode 310, of the base substrate 100.

For example, in a case where the second electrode 312 of the photodiode 310 and the control electrode 213 of the first transistor 210 are integrally formed, the intensity of light reflected by the fingerprint can be determined by detecting the voltage value of the control electrode 213 of the first transistor 210, thereby implementing the fingerprint identification function.

For example, as illustrated in FIG. 4, the display substrate 10 may further include a detection circuit 320. For example, the detection circuit 320 may include an amplification circuit, an analog-to-digital conversion circuit, etc. The detection circuit 320 is electrically connected to the second electrode 312 of the photodiode 310 and the control electrode 213 of the first transistor 210 to detect the electrical signal generated by the photodiode 310. For example, the detection circuit 320 may perform fingerprint identification by detecting the voltage of the second electrode 312 of the photodiode 310; alternatively, the detection circuit 320 may also perform fingerprint identification by detecting other types of electrical signals, such as the current flowing through the second electrode 312 of the photodiode 310. The embodiments of the present disclosure do not limit the specific structure and the detection method of the detection circuit 320.

When the display substrate 10 performs the image display operation, the first electrode 311 of the photodiode 310 is configured to receive a turn-on voltage that allows the photodiode 310 to be turned on. The photodiode 310 in the turn-on state is equivalent to a resistor, and allows the turn-on voltage V2 applied to the first electrode 311 to be transmitted to the control electrode 213 of the first transistor 210, thereby allowing the first transistor 210 to perform the corresponding display operation to implement the normal image display. For example, the turn-on voltage V2 can allow the first transistor 210 to be turned on, and the magnitude of the turn-on voltage V2 can be set according to requirements of the pixel unit including the first transistor 210. The first transistor 210 can be controlled in a voltage manner by adjusting the magnitude of the turn-on voltage V2, and for example, the turn-on voltage V2 may be a data voltage or a gate driving voltage.

For example, the pixel circuit 200 may include a data writing transistor, a driving transistor, a compensation transistor, a light-emitting control transistor, a reset transistor, or the like. The first transistor 210 may be the data writing transistor, the driving transistor, the compensation transistor, the light-emitting control transistor, or the reset transistor in the pixel circuit 200. For example, the data writing transistor is used to write a data signal for display into the pixel circuit according to a scanning control signal, so as to control the driving transistor. The driving transistor is used to control the magnitude of the light-emitting current passing through the driving transistor based on the written data signal, so as to control the light-emitting intensity of the light-emitting component. The compensation transistor is used to implement the compensation operation for the driving transistor, thereby eliminating the adverse influence caused by the fluctuation of the threshold voltage of the driving transistor. The light-emitting control transistor is used to control whether to apply a power voltage to the driving transistor according to the light-emitting control signal. The reset transistor is used to reset the control electrode of the driving transistor or the light-emitting component according to a reset signal.

In the following, the connection mode between the photodiode 310 and different signal lines (such as the gate line, the data line, the bias voltage line that provides the bias voltage, etc.) of the display substrate and the working principle of the photodiode 310 are described by taking a case that the first transistor 210 is the data writing transistor or the driving transistor as an example.

Figure 5A:
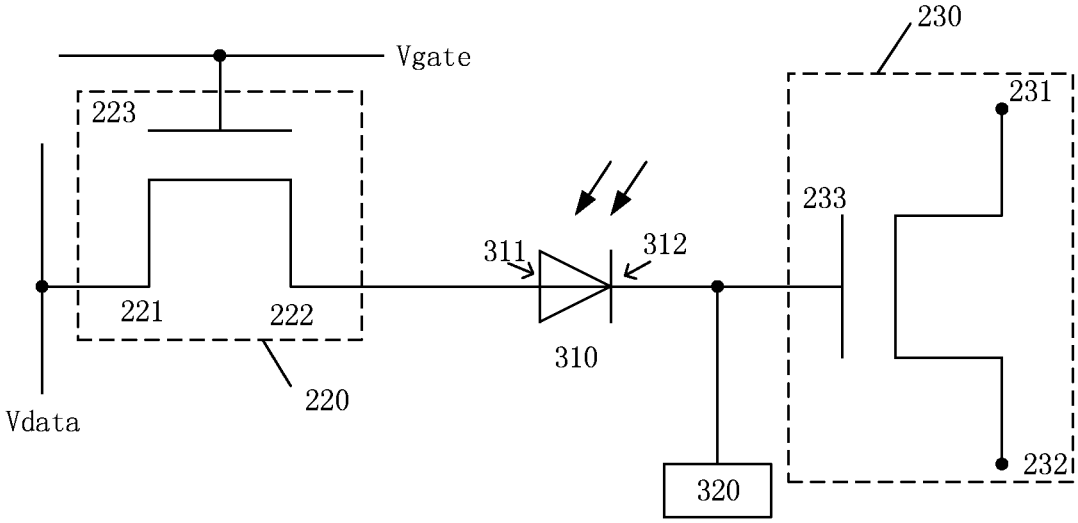
FIG. 5A and FIG. 5B are circuit schematic diagrams of some examples of the working principle of the photodiode illustrated in FIG. 4.
Figure 5B:
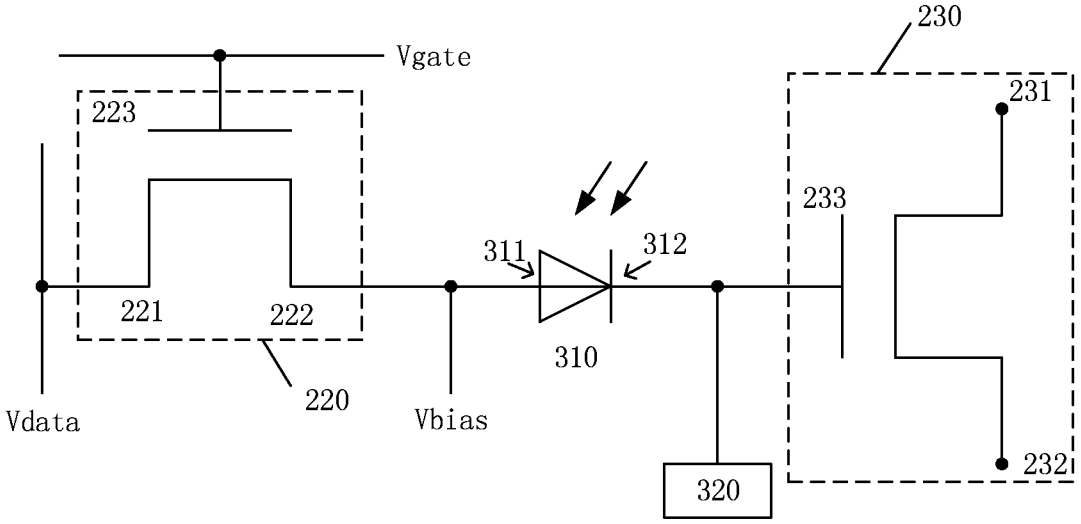

FIG. 5A and FIG. 5B are circuit schematic diagrams of some examples of the working principle of the photodiode 310 illustrated in FIG. 4. As illustrated in FIG. 5A and FIG. 5B, the first electrode 311 of the photodiode 310 is connected to the data writing transistor 220 (i.e., the second transistor), and the second electrode 312 of the photodiode 310 is connected to the driving transistor 230 (i.e., the first transistor). The first electrode 221 of the data writing transistor 220 is connected to the data line Vdata, the second electrode 222 of the data writing transistor 220 is connected to the first electrode 311 of the photodiode 310, and the control electrode 223 of the data writing transistor 220 is connected to the gate line Vgate to receive a gate scanning voltage. The control electrode 233 of the driving transistor 230 is connected to the second electrode 312 of the photodiode 310 and the detection circuit 320, and the first electrode 231 and the second electrode 232 of the driving transistor 230 are respectively connected to other corresponding parts of the pixel circuit 200. For example, the first electrode 231 of the driving transistor 230 is connected to a power voltage terminal, and the second electrode 232 of the driving transistor 230 is connected to the light-emitting component.

For example, as illustrated in FIG. 5A, in a case of photoelectric induction, the data line Vdata provides the bias voltage V1 to the first electrode 311 of the photodiode 310 through the data writing transistor 220, so as to allow the photodiode 310 to be reversely biased. The photodiode 310 converts the optical signal reflected by the fingerprint into the electrical signal, and the detection circuit 320 detects the voltage of the second electrode 312 of the photodiode 310 to determine the intensity of light reflected by the fingerprint, thereby enabling the display substrate 10 to implement the fingerprint identification function. In a case of light emitting, the data line Vdata provides the data voltage, that is, the turn-on voltage V2, to the first electrode 311 of the photodiode 310 through the data writing transistor 220, so as to allow the photodiode 310 to be turned on and to transmit the data voltage to the control electrode 233 of the driving transistor 230, thereby enabling the display substrate 10 to perform the image display operation.

For example, as illustrated in FIG. 5B, the bias voltage V1 of the photodiode 310 may further be additionally provided by an additional bias voltage line Vbias. The bias voltage line Vbias is electrically connected to the first electrode 311 of the photodiode 310. In a case of photoelectric induction, the bias voltage line Vbias provides the bias voltage V1 to the first electrode 311 of the photodiode 310 to allow the photodiode 310 to be reversely biased, the photodiode 310 converts the optical signal reflected by the fingerprint into the electrical signal, and the detection circuit 320 detects the voltage of the second electrode 312 of the photodiode 310 to determine the intensity of light reflected by the fingerprint, thereby enabling the display substrate 10 to implement the fingerprint identification function. In a case of light emitting, the data line Vdata provides the data voltage, that is, the turn-on voltage V2, to the first electrode 311 of the photodiode 310 through the data writing transistor 220, so as to allow the photodiode 310 to be turned on and to transmit the data voltage to the control electrode 233 of the driving transistor 230, thereby enabling the display substrate 10 to perform the image display operation.

It should be noted that, in the example illustrated in FIG. 5B, in the case of photoelectric induction, the data writing transistor 220 is in the turn-off state; and in the case of light emitting, the bias voltage line Vbias is floating, that is, no voltage signal is provided to the bias voltage line Vbias.

It should be noted that, in the examples illustrated in FIG. 5A and FIG. 5B, the driving transistor 230 is in the turn-off state in the case of photoelectric induction. For example, the reset circuit electrically connected to the second electrode 312 of the photodiode 310 and the control electrode 233 of the driving transistor 230 can be provided, so that during the fingerprint identification operation, the voltage of the second electrode 312 and the voltage of the control electrode 233 are reset, thereby ensuring that the driving transistor 230 is in the turn-off state while the photodiode 310 is biased, so as to avoid the driving transistor 230 from outputting the current. For example, in a case where the driving transistor 230 is an N-type transistor, in the case of photoelectric induction, the voltage of the second electrode 312 and the voltage of the control electrode 233 can be set to, for example, 0V through the reset circuit, and the bias voltage V1 provided to the first electrode 311 is set to, for example, a negative voltage, thereby allowing the photodiode 310 to be biased and allowing the driving transistor 230 to be in the turn-off state. For example, in a case where the driving transistor 230 is a P-type transistor, in the case of photoelectric induction the voltage of the second electrode 312 and the voltage of the control electrode 233 can be set to, for example, a high voltage through the reset circuit, and the bias voltage V1 provided to the first electrode 311 is set to, for example, 0V, thereby allowing the photodiode 310 to be biased and allowing the driving transistor 230 to be in the turn-off state.

For example, different from the examples illustrated in FIG. 5A and FIG. 5B, in some other examples, the second electrode 312 of the photodiode 310 may be connected to both the data writing transistor 220 and the driving transistor 230, and the first electrode 311 of the photodiode 310 is individually connected to the bias voltage line Vbias. In this case, the first electrode 311 of the photodiode 310 is not directly connected to any one of the data writing transistor 220 and the driving transistor 230.

Figure 6A:
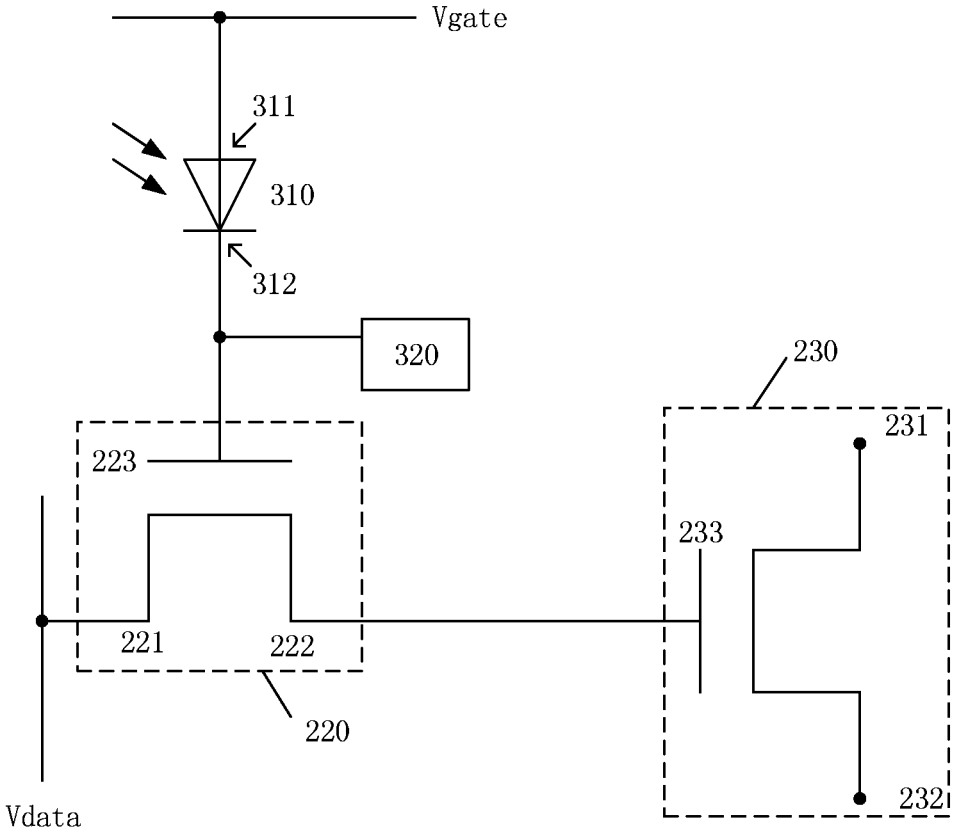
FIG. 6A and FIG. 6B are circuit schematic diagrams of some other examples of the working principle of the photodiode illustrated in FIG. 4.
Figure 6B:
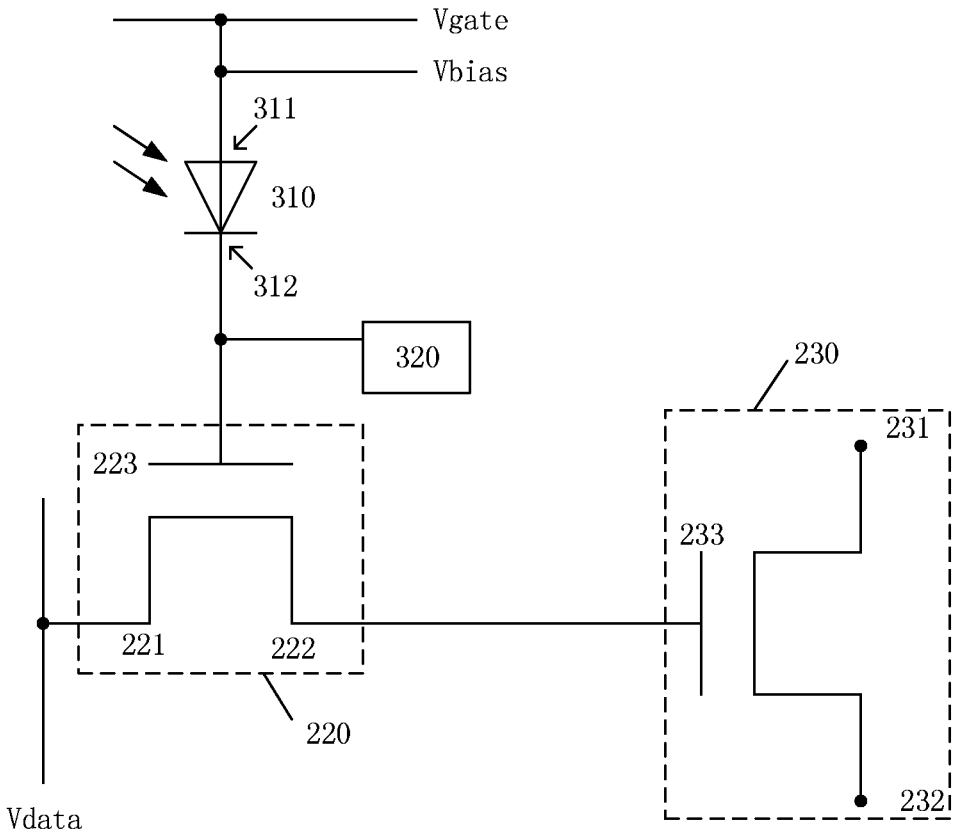

FIG. 6A and FIG. 6B are circuit schematic diagrams of some other examples of the working principle of the photodiode 310 illustrated in FIG. 4. As illustrated in FIG. 6A and FIG. 6B, the first electrode 311 of the photodiode 310 is connected to the gate line Vgate, and the second electrode 312 of the photodiode 310 is connected to the control electrode 223 of the data writing transistor 220 and the detection circuit 320. The first electrode 221 of the data writing transistor 220 is connected to the data line Vdata to receive the data voltage, and the second electrode 222 of the data writing transistor 220 is connected to the control electrode 233 of the driving transistor 230 to control the turn-on state of the driving transistor 230. The first electrode 231 and the second electrode 232 of the driving transistor 230 are respectively connected to other corresponding parts of the pixel circuit 200.

For example, as illustrated in FIG. 6A, in the case of photoelectric induction, the gate line Vgate provides the bias voltage V1 to the first electrode 311 of the photodiode 310 to allow the photodiode 310 to be reversely biased, the photodiode 310 converts the optical signal reflected by the fingerprint into the electrical signal, and the detection circuit 320 detects the voltage of the second electrode 312 of the photodiode 310 to determine the intensity of light reflected by the fingerprint, thereby enabling the display substrate 10 to implement the fingerprint identification function. In the case of light emitting, the gate line Vgate provides the gate scanning voltage, that is, the turn-on voltage V2, to the first electrode 311 of the photodiode 310, so as to allow the photodiode 310 to be turned on and to transmit the gate scanning voltage to the control electrode 223 of the data writing transistor 220, thereby enabling the display substrate 10 to perform the image display operation.

For example, as illustrated in FIG. 6B, the bias voltage V1 of the photodiode 310 may further be additionally provided by an additional bias voltage line Vbias. The bias voltage line Vbias is electrically connected to the first electrode 311 of the photodiode 310. In the case of photoelectric induction, the bias voltage line Vbias provides the bias voltage V1 to the first electrode 311 of the photodiode 310 to allow the photodiode 310 to be biased, the photodiode 310 converts the optical signal reflected by the fingerprint into the electrical signal, and the detection circuit 320 detects the voltage of the second electrode 312 of the photodiode 310 to determine the intensity of light reflected by the fingerprint, thereby enabling the display substrate 10 to implement the fingerprint identification function. In the case of light emitting, the gate line Vgate provides the gate scanning voltage, that is, the turn-on voltage V2, to the first electrode 311 of the photodiode 310, so as to allow the photodiode 310 to be turned on and to transmit the gate scanning voltage to the control electrode 223 of the data writing transistor 220, thereby enabling the display substrate 10 to perform the image display operation. It should be noted that, in the example illustrated in FIG. 6B, in the case of photoelectric induction, the gate line Vgate is in a floating state; and in the case of light emitting, the bias voltage line Vbias is in a floating state, that is, no voltage signal is provided to the bias voltage line Vbias.

It should be noted that, in the examples illustrated in FIG. 6A and FIG. 6B, the data writing transistor 220 is in the turn-off state in the case of photoelectric induction. For example, the reset circuit electrically connected to the second electrode 312 of the photodiode 310 and the control electrode 223 of the data writing transistor 220 can be provided, so that during the fingerprint identification operation, the voltage of the second electrode 312 and the voltage of the control electrode 223 are reset, thereby ensuring that the data writing transistor 220 is in the turn-off state while the photodiode 310 is biased, so as to avoid such as the data current passing through the data writing transistor 220. For example, in a case where the data writing transistor 220 is an N-type transistor, in the case of photoelectric induction, the voltage of the second electrode 312 and the voltage of the control electrode 223 can be set to, for example, 0V through the reset circuit, and the bias voltage V1 provided to the first electrode 311 is set to, for example, a negative voltage, thereby allowing the photodiode 310 to be biased and allowing the data writing transistor 220 to be in the turn-off state. For example, in a case where the data writing transistor 220 is a P-type transistor, in the case of photoelectric induction, the voltage of the second electrode 312 and the voltage of the control electrode 223 can be set to, for example, a high voltage through the reset circuit, and the bias voltage V1 provided to the first electrode 311 is set to, for example, 0V, thereby allowing the photodiode 310 to be biased and allowing the data writing transistor 220 to be in the turn-off state.

For example, different from the examples illustrated in FIG. 6A and FIG. 6B, in some other examples, the second electrode 312 of the photodiode 310 may be connected to the control electrode of the data writing transistor 220, and the first electrode 311 of the photodiode 310 is individually connected to the bias voltage line Vbias. In this case, the first electrode 311 of the photodiode 310 is not directly connected to any one of the data writing transistor 220 and the driving transistor 230.

Figure 7:
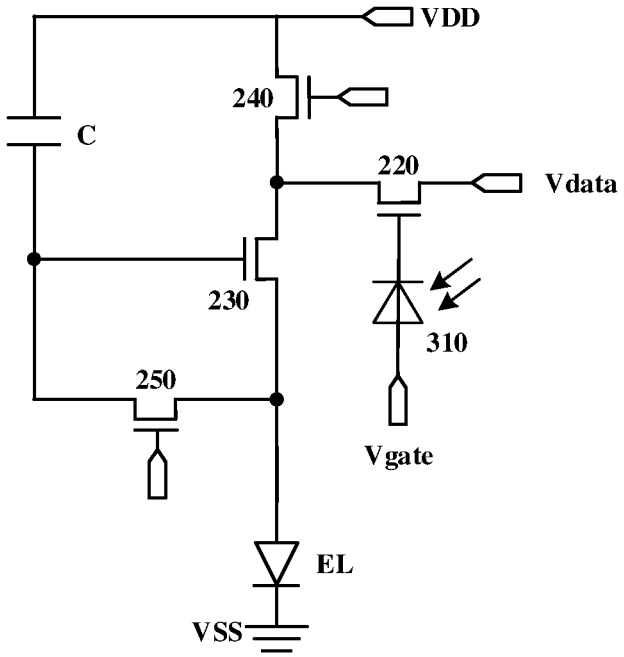
FIG. 7 is a circuit diagram of an example of a pixel circuit provided by some embodiments of the present disclosure.

In some embodiments of the present disclosure, in order to obtain a better image display effect, the pixel circuit 200 may further include an additional compensating circuit. FIG. 7 is a circuit diagram of an example of the pixel circuit 200 provided by some embodiments of the present disclosure.

As illustrated in FIG. 7, the pixel circuit 200 includes the data writing transistor 220, the capacitor C, the driving transistor 230, the light-emitting control transistor 240, the compensation transistor 250, the reset transistor (not shown), etc. As illustrated in FIG. 7, the first electrode of the data writing transistor 220 is connected to the data line Vdata, the second electrode of the data writing transistor 220 is connected to the first electrode of the driving transistor 230, the control electrode of the data writing transistor 220 is connected to the gate line Vgate through the photodiode 310, and the data writing transistor 220 is configured to write the data voltage into the control electrode of the driving transistor 230 under control of the gate scanning voltage. The second electrode of the driving transistor 230 is connected to the first terminal of the light-emitting component EL, the second terminal of the light-emitting component EL is connected to the second power terminal VSS, the control electrode of the driving transistor 230 is connected to the first terminal of the capacitor C, the second terminal of the capacitor C is connected to the first power terminal VDD, and the driving transistor 230 is configured to drive the light-emitting component EL to emit light under control of the data voltage. The first electrode of the light-emitting control transistor 240 is connected to the first power terminal VDD, the second electrode of the light-emitting control transistor 240 is connected to the first electrode of the driving transistor 230, the control electrode of the light-emitting control transistor 240 is configured to receive the light-emitting control signal, and the light-emitting control transistor 240 is configured to control the first power terminal VDD to be connected or disconnected to the driving transistor 230 and the light-emitting component EL under control of the light-emitting control signal. The first electrode of the compensation transistor 250 is connected to the second electrode of the driving transistor 230, the second electrode of the compensation transistor 250 is connected to the control electrode of the driving transistor 230 and the first terminal of the capacitor C, the control electrode of the compensation transistor 250 is configured to receive the compensation control signal, and the compensation transistor 250 is configured to compensate the threshold voltage of the driving transistor 230. The reset transistor is configured to reset the control electrode of the driving transistor 230.

For example, as illustrated in FIG. 7, the photodiode 310 can be integrated with the display substrate 10 by being electrically connected to the data writing transistor 220, that is, as the connection method illustrated in FIG. 6A or FIG. 6B. It should be noted that, the photodiode 310 may further be integrated with the display substrate 10 by being electrically connected to such as the light-emitting control transistor 240, the compensation transistor 250, or the reset transistor (not shown), and the embodiments of the present disclosure are not limited thereto.

At least an embodiment of the present disclosure further provides a method for manufacturing the display substrate according to any one of the embodiments of the present disclosure.

Figure 8:
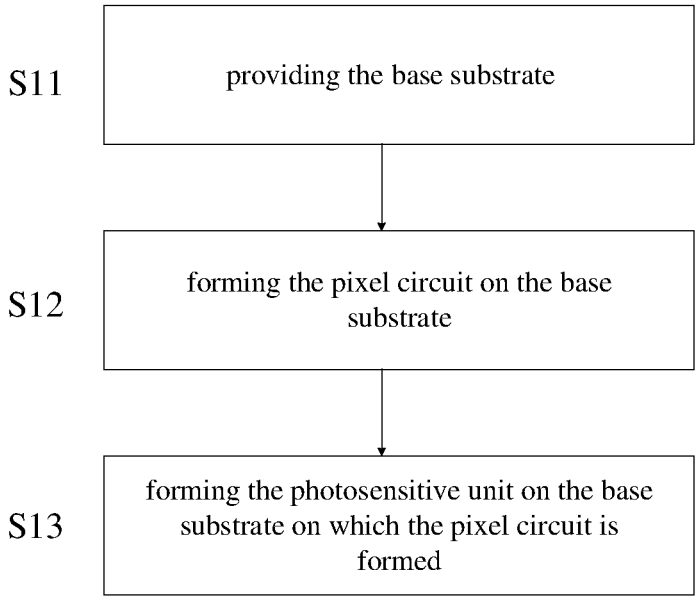
FIG. 8 is a flowchart of a method for manufacturing a display substrate provided by some embodiments of the present disclosure.

FIG. 8 is a flowchart of a method for manufacturing the display substrate 10 provided by some embodiments of the present disclosure. As illustrated in FIG. 8, the manufacturing method includes steps S11, S12, and S13.

Step S11: providing the base substrate.

Step S12: forming the pixel circuit on the base substrate.

Step S13: forming the photosensitive unit on the base substrate on which the pixel circuit is formed, so as to allow the orthographic projection of the photosensitive unit on the base substrate to at least partially overlap with the orthographic projection of the first transistor of the pixel circuit on the base substrate.

Figure 9:
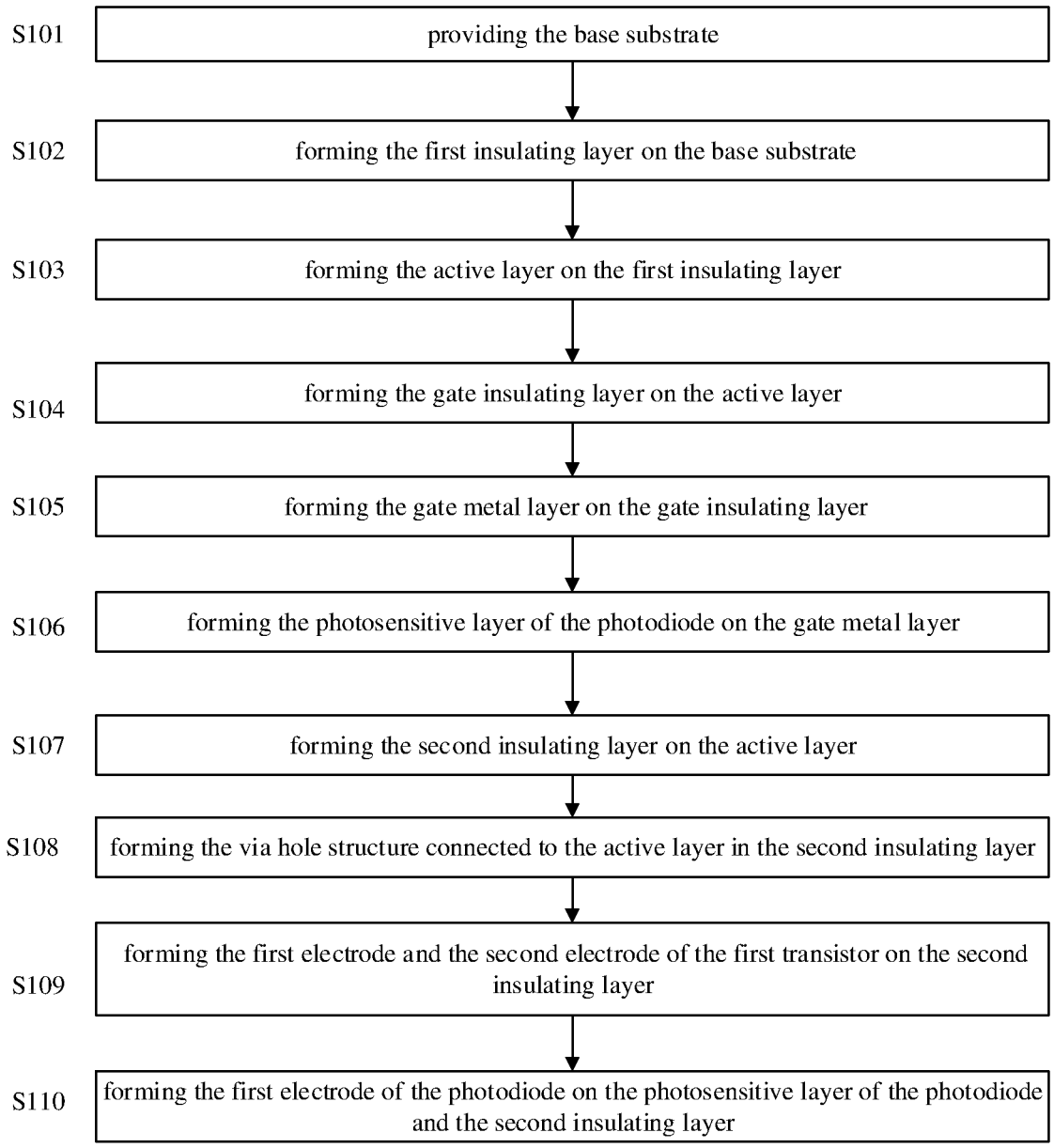
FIG. 9 is a flowchart of an example of a method for manufacturing a display substrate provided by some embodiments of the present disclosure.

In the following, the method for manufacturing the display substrate provided by the embodiments of the present disclosure will be specifically described by taking the structure of the display substrate 10 illustrated in FIG. 3 as an example. FIG. 9 is a flowchart of an example of the method for manufacturing the display substrate 10 provided by some embodiments of the present disclosure. With reference to FIG. 3 and FIG. 9, the manufacturing method includes the following steps S101 to S110.

Step S101: providing the base substrate 100. For example, the base substrate 100 may be a glass substrate, a plastic substrate, or other flexible substrates.

Step S102: forming the first insulating layer 111 on the base substrate 100. For example, the first insulating layer 111 may be formed by a physical vapor deposition method, a chemical vapor deposition method, or a coating method, and the first insulating layer 111 may be an inorganic insulating layer or an organic insulating layer.

Step S103: forming the active layer 112 on the first insulating layer 111. The active layer 112 may include amorphous silicon, polysilicon, an oxide semiconductor, etc., and may be patterned by, for example, the photolithography process.

Step S104: forming the gate insulating layer 113 on the active layer 112. For example, the gate insulating layer 113 may be formed by a physical vapor deposition method, a chemical vapor deposition method, or a coating method, and the gate insulating layer 113 may be an inorganic insulating layer or an organic insulating layer.

Step S105: forming the gate metal layer 114 on the gate insulating layer 113. For example, the gate metal layer 114 may be patterned by using the same patterning process as the gate insulating layer 113. For example, the gate metal layer 114 may comprise molybdenum or molybdenum alloy, aluminum or aluminum alloy, copper or copper alloy, etc.

Step S106: sequentially forming the n+-a-Si layer 316, the I-a-Si layer 315, and the p+-a-Si layer 314 of the photosensitive layer 313 of the photodiode 310 on the gate metal layer 114.

Step S107: forming the second insulating layer 115 on the active layer 112. For example, the second insulating layer 115 may be formed by a physical vapor deposition method, a chemical vapor deposition method, or a coating method, and the second insulating layer 115 may be an inorganic insulating layer or an organic insulating layer.

Step S108: forming the via hole structure 116, connected to the first electrode region and the second electrode region (such as the source electrode region and the drain electrode region) of the active layer 112, in the second insulating layer 115.

Step S109: forming the first electrode 211 and the second electrode 212 of the first transistor 210 on the second insulating layer 115. The first electrode 211 and the second electrode 212 of the first transistor 210 are electrically connected to the active layer 112 through the via hole structure 116.

Step S110: forming the first electrode 311 of the photodiode 310 on the photosensitive layer 313 of the photodiode 310 and the second insulating layer 115.

The methods for manufacturing the display substrate provided by other embodiments of the present disclosure are similar to the above methods, and details are not described herein.

Figure 10:
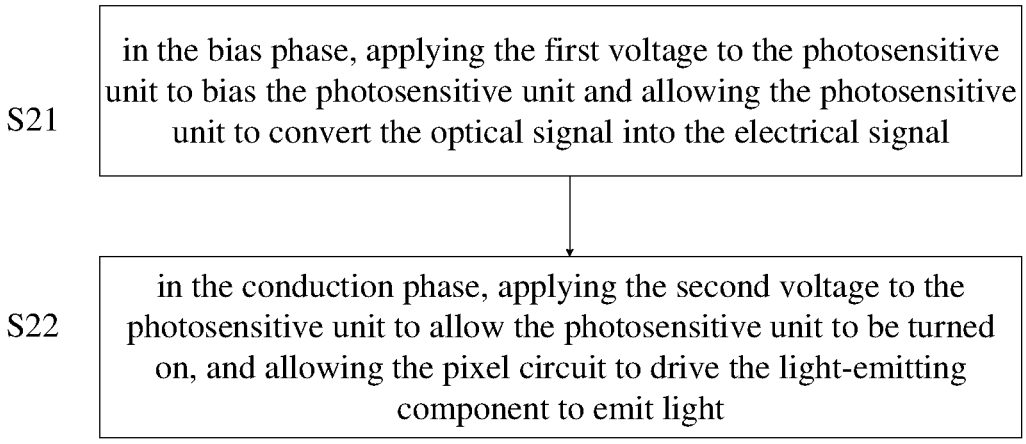
FIG. 10 is a flowchart of a method for driving a display substrate provided by some embodiments of the present disclosure.

At least an embodiment of the present disclosure further provides a method for driving the display substrate according to any one of the embodiments of the present disclosure. FIG. 10 is a flowchart of a method for driving the display substrate 10 provided by some embodiments of the present disclosure. As illustrated in FIG. 10, the driving method includes steps S21 and S22.

Step S21: In the bias phase, applying the first voltage to the photosensitive unit 310 to bias the photosensitive unit 310, and allowing the photosensitive unit 310 to convert the optical signal into the electrical signal.

For example, the first voltage (i.e., the bias voltage V1) may be a negative voltage. In the case, as illustrated in FIG. 5, where the first electrode 311 of the photosensitive unit 310 is electrically connected to the data line Vdata through the data writing transistor 220, the display substrate 10 can control the data writing transistor 220 to be turned on and apply the first voltage to the photosensitive unit 310 through the data line Vdata, so as to allow the photosensitive unit 310 to be biased. In the case, as illustrated in FIG. 6A, where the first electrode 311 of the photosensitive unit 310 is electrically connected to the gate line Vgate, the display substrate 10 can apply the first voltage to the photosensitive unit 310 through the gate line Vgate, so as to allow the photosensitive unit 310 to be biased. Alternatively, in the case, as illustrated in FIG. 5B or FIG. 6B, where the first electrode 311 of the photosensitive unit 310 is electrically connected to the bias voltage line Vbias, the display substrate 10 can apply the first voltage to the photosensitive unit 310 through the bias voltage line Vbias, so as to allow the photosensitive unit 310 to be biased.

Step S22: in the conduction phase, applying the second voltage to the photosensitive unit 310 to allow the photosensitive unit 310 to be turned on, and allowing the pixel circuit 200 to drive the light-emitting component to emit light.

For example, the second voltage (i.e., the turn-on voltage V2) may be a positive voltage. In the case, as illustrated in FIG. 5A and FIG. 5B, where the first electrode 311 of the photosensitive unit 310 is electrically connected to the data line Vdata through the data writing transistor 220, the display substrate 10 can control the data writing transistor 220 to be turned on and apply the second voltage to the photosensitive unit 310 through the data line Vdata, so as to allow the photosensitive unit 310 to be turned on. For example, the second voltage may be the data voltage. In the case, as illustrated in FIG. 6A and FIG. 6B, where the first electrode 311 of the photosensitive unit 310 is electrically connected to the gate line Vgate, the display substrate 10 can apply the second voltage to the photosensitive unit 310 through the gate line Vgate, and for example, the second voltage may be the gate scanning voltage.

At least an embodiment of the present disclosure further provides a display panel including the display substrate according to any one of the embodiments of the present disclosure.

Figure 11:
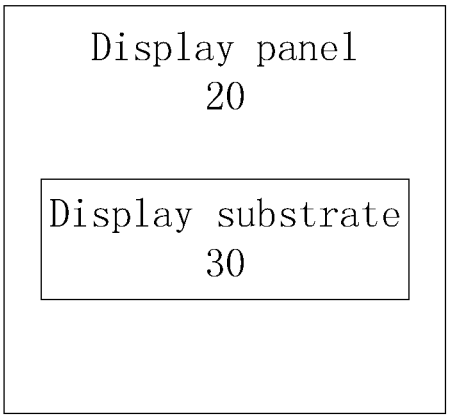
FIG. 11 is a schematic block diagram of a display panel provided by some embodiments of the present disclosure.

FIG. 11 is a schematic block diagram of a display panel 20 provided by some embodiments of the present disclosure. The display panel 20 includes a display substrate 30 according to any one of the embodiments of the present disclosure, and for example, the display panel 20 may include the display substrate 10 illustrated in FIG. 1. The technical effects and implementation principles of the display panel 20 are the same as or similar to those of the display substrate described in the embodiments of the present disclosure, and details are not described herein.

For example, the display panel 20 may be any product or component having a display function, such as a liquid crystal panel, an electronic paper, an OLED panel, a mobile phone, a tablet computer, a television, a display screen, a notebook computer, a digital photo frame, a navigator, etc.

The following statements should be noted:

(1) The accompanying drawings involve only the structure(s) in connection with the embodiment(s) of the present disclosure, and other structure(s) can be referred to common design(s).

(2) In order to clearly illustrate, the thickness of a layer or an area may be enlarged or narrowed in the drawings for describing the embodiments of the present disclosure, that is, the drawings are not drawn in a real scale. It is to be understood that, when a member such as a layer, a film, an area, or a substrate is located or disposed "on" or "below" another member, the member can be located or disposed "on" or "below" the another member "directly", or an intermediate member or intermediate member(s) can be disposed.

(3) In case of no conflict, the embodiments of the present disclosure and features in the embodiments can be combined with each other to obtain new embodiments.

What have been described above are only specific implementations of the present disclosure, the protection scope of the present disclosure is not limited thereto. Any modifications or substitutions easily occur to those skilled in the art within the technical scope of the present disclosure should be within the protection scope of the present disclosure. Therefore, the protection scope of the present disclosure should be based on the protection scope of the claims.

What is claimed is:

1. A display substrate, comprising: a base substrate, a pixel circuit, and a photosensitive unit, wherein the pixel circuit and the photosensitive unit are on the base substrate, the pixel circuit comprises a first transistor, an orthographic projection of the photosensitive unit on the base substrate at least partially overlaps with an orthographic projection of the first transistor on the base substrate, and the first transistor is configured to perform a display operation.

2. The display substrate according to claim 1, wherein the orthographic projection of the photosensitive unit on the base substrate is within the orthographic projection of the first transistor on the base substrate.

3. The display substrate according to claim 2, wherein the photosensitive unit is a photodiode and is on a side, away from the base substrate, of the first transistor, the photodiode comprises a first electrode and a second electrode, the first electrode of the photodiode is configured to receive a bias voltage to bias the photodiode, and the second electrode of the photodiode is configured to be electrically connected to the first transistor.

4. The display substrate according to claim 2, further comprising a plurality of pixel circuits and a plurality of photosensitive units, wherein the plurality of pixel circuits and the plurality of photosensitive units are on the base substrate in an overlapping manner, and the plurality of pixel circuits and the plurality of photosensitive units are in one-to-one correspondence.

5. The display substrate according to claim 1, wherein the photosensitive unit is a photodiode and is on a side, away from the base substrate, of the first transistor, the photodiode comprises a first electrode and a second electrode, the first electrode of the photodiode is configured to receive a bias voltage to bias the photodiode, and the second electrode of the photodiode is configured to be electrically connected to the first transistor.

6. The display substrate according to claim 5, wherein the first transistor comprises a control electrode, and the control electrode of the first transistor is configured to be electrically connected to the second electrode of the photodiode.

7. The display substrate according to claim 6, wherein the second electrode of the photodiode is further configured to be the control electrode of the first transistor, the photodiode further comprises a photosensitive layer, and the photosensitive layer is between the second electrode of the photodiode and the first electrode of the photodiode relative to the base substrate.

8. The display substrate according to claim 5, further comprising a detection circuit, wherein the detection circuit is configured to be electrically connected to the second electrode of the photodiode to detect an electrical signal of the second electrode of the photodiode.

9. The display substrate according to claim 5, further comprising a signal line, wherein the first electrode of the photodiode is electrically connected to the signal line.

10. The display substrate according to claim 9, wherein the pixel circuit further comprises a second transistor, a first electrode of the second transistor is electrically connected to the signal line, a control electrode of the second transistor is electrically connected to a gate line, a second electrode of the second transistor is electrically connected to the first electrode of the photodiode, the second electrode of the photodiode is electrically connected to the control electrode of the first transistor, a first electrode of the first transistor is electrically connected to a power voltage terminal, and a second electrode of the first transistor is electrically connected to a light-emitting component.

11. The display substrate according to claim 5, further comprising a signal line and a bias voltage line, wherein the signal line and the bias voltage line are electrically connected to the first electrode of the photodiode, respectively.

12. The display substrate according to claim 5, further comprising a plurality of pixel circuits and a plurality of photosensitive units, wherein the plurality of pixel circuits and the plurality of photosensitive units are on the base substrate in an overlapping manner, and the plurality of pixel circuits and the plurality of photosensitive units are in one-to-one correspondence.

13. The display substrate according to claim 1, further comprising a plurality of pixel circuits and a plurality of photosensitive units, wherein the plurality of pixel circuits and the plurality of photosensitive units are on the base substrate in an overlapping manner, and the plurality of pixel circuits and the plurality of photosensitive units are in one-to-one correspondence.

14. A display panel, comprising the display substrate according to claim 1.

15. A method for manufacturing the display substrate according to claim 1, comprising:

providing the base substrate;

forming the pixel circuit on the base substrate; and forming the photosensitive unit on the base substrate on which the pixel circuit is formed, so as to allow the orthographic projection of the photosensitive unit on the base substrate to at least partially overlap with the orthographic projection of the first transistor of the pixel circuit on the base substrate.

16. A method for driving a display substrate, wherein the display substrate comprises a base substrate, a pixel circuit, and a photosensitive unit, the pixel circuit and the photosensitive unit are on the base substrate, the pixel circuit comprises a first transistor, and an orthographic projection of the photosensitive unit on the base substrate at least partially overlaps with an orthographic projection of the first transistor on the base substrate; and the method comprises:

in a first phase, applying a first voltage to the photosensitive unit to bias the photosensitive unit and allowing the photosensitive unit to convert an optical signal into an electrical signal; and in a second phase, applying a second voltage to the photosensitive unit to allow the photosensitive unit to be turned on, and allowing the pixel circuit to drive a light-emitting component to emit light.

17. The method for driving the display substrate according to claim 16, wherein the photosensitive unit is electrically connected to a signal line, the first voltage is applied to the photosensitive unit through the signal line to bias the photosensitive unit, and the second voltage is applied to the photosensitive unit through the signal line to allow the photosensitive unit to be turned on.

18. The method for driving the display substrate according to claim 17, wherein the pixel circuit further comprises a second transistor, and the method further comprises:

in the first phase, controlling the second transistor to be turned on and applying the first voltage to the photosensitive unit through the signal line to bias the photosensitive unit; and in the second phase, controlling the second transistor to be turned on and applying the second voltage to the photosensitive unit through the signal line to allow the photosensitive unit to be turned on, wherein the second voltage is a data voltage.

* * * * *